US005909730A

United States Patent [19]

Lehmann et al.

[11] Patent Number: 5,909,730

[45] Date of Patent: Jun. 8, 1999

[54] BITUMEN CONTAINER

[75] Inventors: Peter Lehmann, Wadeville, South Africa; Jacques Grisoni, La Croix-sur-Lutry, Switzerland

[73] Assignees: Henred-Fruehauf Trailers (Proprietary) Limited, South Africa; Cont-Asphalt Limited, Seychelles, Switzerland

[21] Appl. No.: 08/822,429

[22] Filed: Mar. 21, 1997

[51] Int. Cl.[6] ..... F24H 9/00

[52] U.S. Cl. ..... 126/343.5 A; 126/373

[58] Field of Search ..... 126/343.5 A, 343.5 R, 126/369, 369.1, 350 R, 271.1, 373–376

[56] References Cited

U.S. PATENT DOCUMENTS

| | | | |
|---|---|---|---|
| 1,962,657 | 6/1934 | Hendricks | 126/343.5 A |
| 3,503,381 | 3/1970 | Role | 126/343.5 A |
| 3,633,563 | 1/1972 | Osborn | 126/343.5 A |
| 4,028,527 | 6/1977 | Thagard, Jr. | 126/343.5 A |

FOREIGN PATENT DOCUMENTS

| | | | |
|---|---|---|---|
| 2137116 | 7/1973 | Germany | 126/343.5 A |
| 762796 | 12/1956 | United Kingdom | 126/343.5 A |

*Primary Examiner*—James C. Yeung

*Attorney, Agent, or Firm*—McDonnell Boehnen Hulbert & Berghoff

[57] ABSTRACT

THE INVENTION provides a beatable container for bitumen, cut-back or the like, comprising a body member defining a base zone, side wall zones, end wall zone and a roof zone, characterized in means for transmitting heat from a heating medium to the base zone and to at least part of the side wall zones of the container.

6 Claims, 6 Drawing Sheets

BITUMEN CONTAINER

FIELD OF THE INVENTION

THIS invention relates to a heatable container suitable for transporting and dispensing bitumen and cut-back compositions thereof.

OBJECT OF THE INVENTION

An object of the present invention is to provide a novel bitumen container which is capable of a certain degree of pressurization and accordingly suitable for conveying cut-back compositions of bitumen or the like.

A further object of the invention is to provide a container with a heating facility whereby material m the container can be heated to a molten state for dispensing purposes.

A further object of the present invention is to provide a container suitable for bitumen or the like which is provided with a heating facility whereby a large contact area of the container will transmit heat to the bitumen to minimize degradation thereof.

SUMMARY OF THE INVENTION

According to the invention a container suitable for bitumen, cut-back or the like comprises a body member defining a base zone, side wall zones, end wall zones and a roof zone, characterized in means for transmitting heat from a heating medium to the base zone and to at least part of the side wall zones of the container. In one embodiment the means for transmitting heat from a heating medium will be adapted to transmit heat to the base zone, the side wall zones, and also to the roof zone of the container.

Further according to the invention the means for transmitting heat from the heating medium comprises a heating box or duct or the like disposed adjacent the base zone and at least part of the side wall zones of the container. In a preferred embodiment a heating box or duct for a heating medium will be constructed below the container base zone and extend at least partially up the side wall zones. Preferably also the heating box will include internal partitioning to define a pathway for heating medium to move from one or more burners to one or more chimney outlets along adjacent outward bound and return passages. Alternatively, the duct could be in the form of a plurality of pipe lengths disposed longitudinally about the periphery of the container, parallel to the longitudinal axis of the container, the pipe keys being adapted to duct heating medium therethrough, along a sinuous outward and return pathway.

It is a further feature of the invention that the container will be in the form of a tank structure with the base zone, side wall zones and roof zone defining a tubular structure of generally circular cross-section, and the end zones being domed outwardly.

Further according to the invention the tank structure will be mounted on supports within an ISO container frame. Preferably the domed ends of the tank will terminate short of the ends of the frame structure at one, or preferably both ends. It has been found that this feature will permit access to equipment such as burners disposed at the ends zones, even when the container is parked against a bulkhead or the like. Thus in one embodiment, one and preferably both ends will terminate approximately 0.05 meters short of the ends of the frame structure. With such an arrangement the diameter of the tank in cross-section will be approximately 2.300 meters.

DESCRIPTION OF DRAWINGS

In order more clearly to illustrate the invention an embodiment thereof is described hereunder purely by way of example with reference to the accompanying drawings wherein.

DESCRIPTION OF A PREFERRED EMBODIMENT

Figure 1:
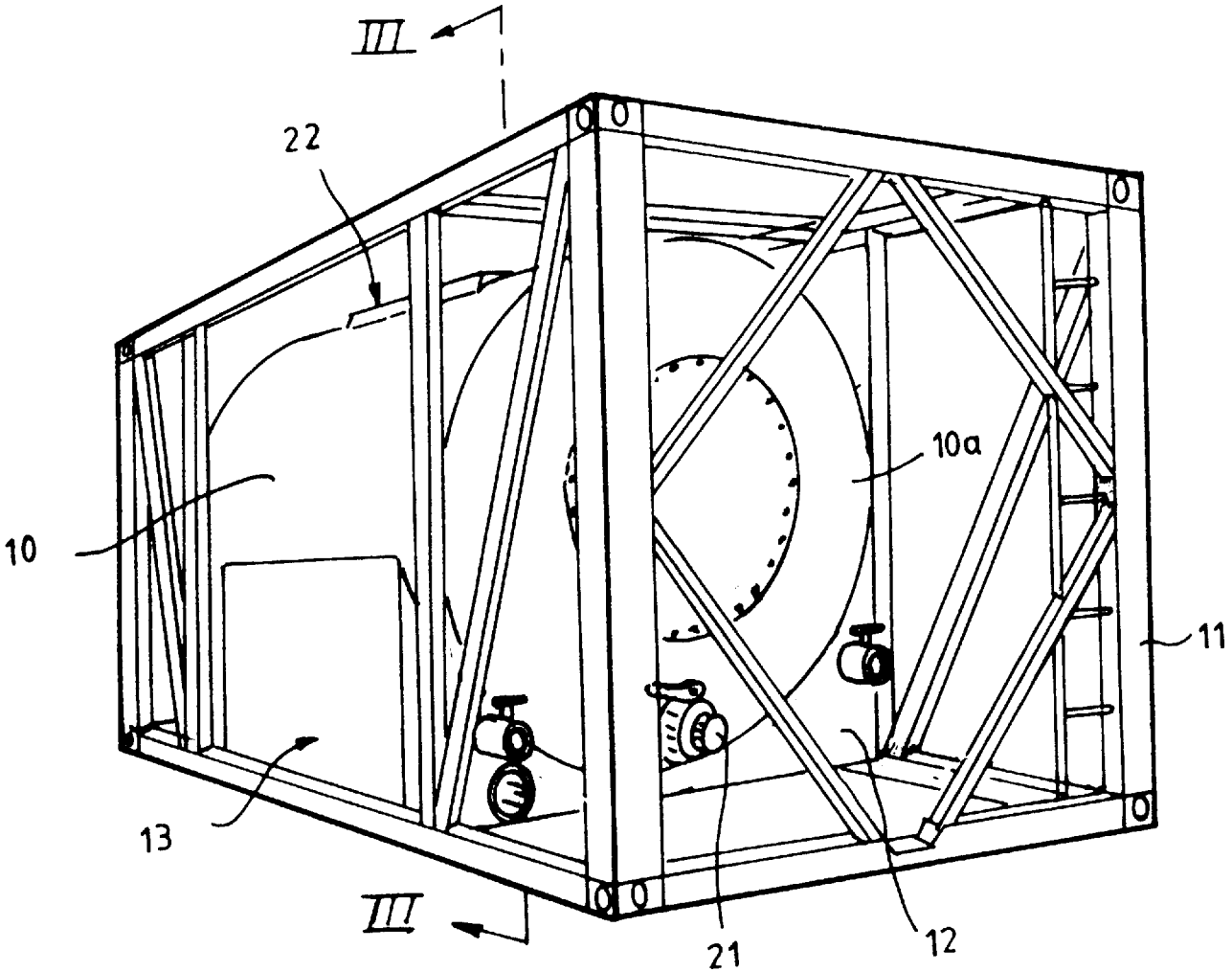
FIG. 1 is a schematic perspective view of a bitumen and cut-back container in accordance with the invention.
Figure 2:
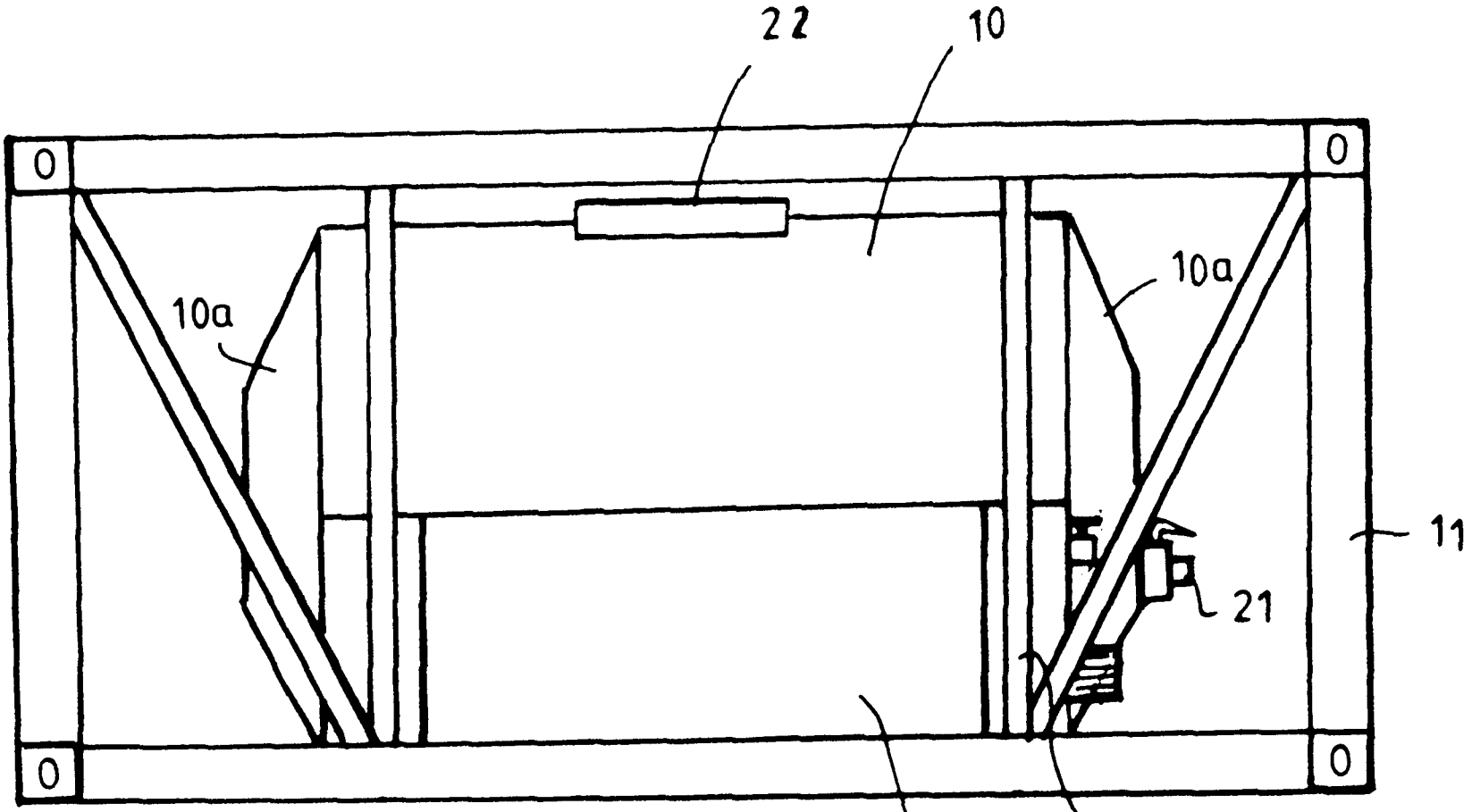
FIG. 2 is a schematic sectioned elevation of the container in FIG. 1.

Referring to the drawings container for bitumen, cut-back or the like comprises a pressure vessel in the form of a tank 10 having a elongated body of substantially circular cross-section which terminates at its ends in outwardly domed end sections 10*a*. It is a feature of the invention that the tank 10 should be capable of being pressurized for example for conveying a cut-back bitumen formulation, and the construction will accordingly be in accordance with ISO standard IMO-type II specifications.

The tank 10 described above will be mounted in a frame 11 which also complies with ISO specifications for containers in respect of dimensions, mounting means, etc. As shown in the drawings the tank 10 will be mounted on a pair of spaced cradle formations 12 and it will be noted that the domed ends 10*a* of the tank 10 structure terminates short of the ends of the frame 11. Preferably a space of approximately 0.5 meters will be left between the domed ends 10*a* and the end of the frame 11. This feature of the invention serves to provide access to equipment such as oil burners which are discussed in more detail below, in situations wherein the container frame 11 is stacked against an adjacent frame, bulkhead or the like.

Thus where the length of the frame structure is 6.058 meters, the length of the tank will preferably be in the order of 5.00 meters. In accordance with ISO standards, the height and width of the frame structure will be 2.591 meters and 2.438 meters respectfully.

Figure 3:
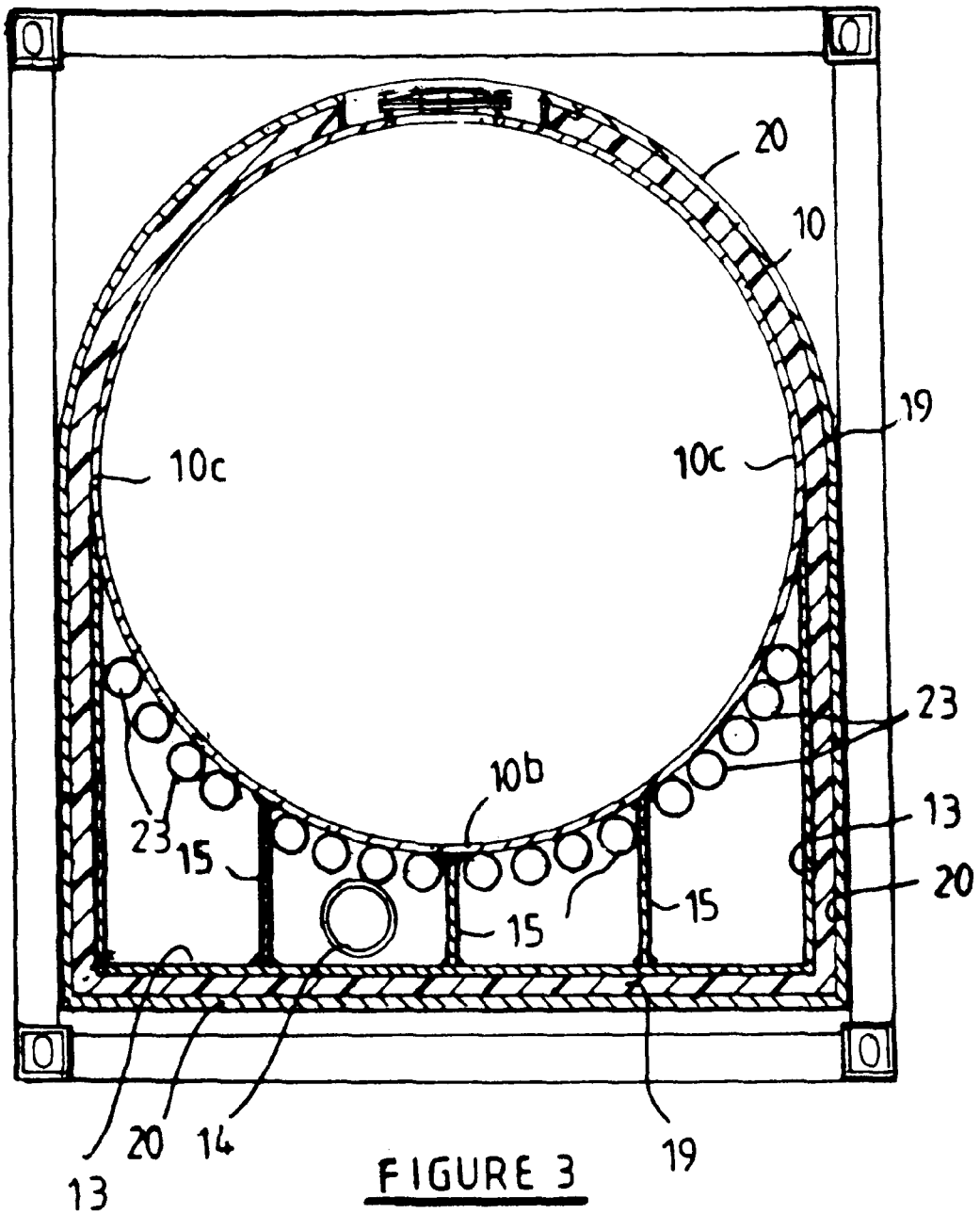
FIG. 3 is a schematic sectioned end elevation on line III—III in FIG. 1.
Figure 4:
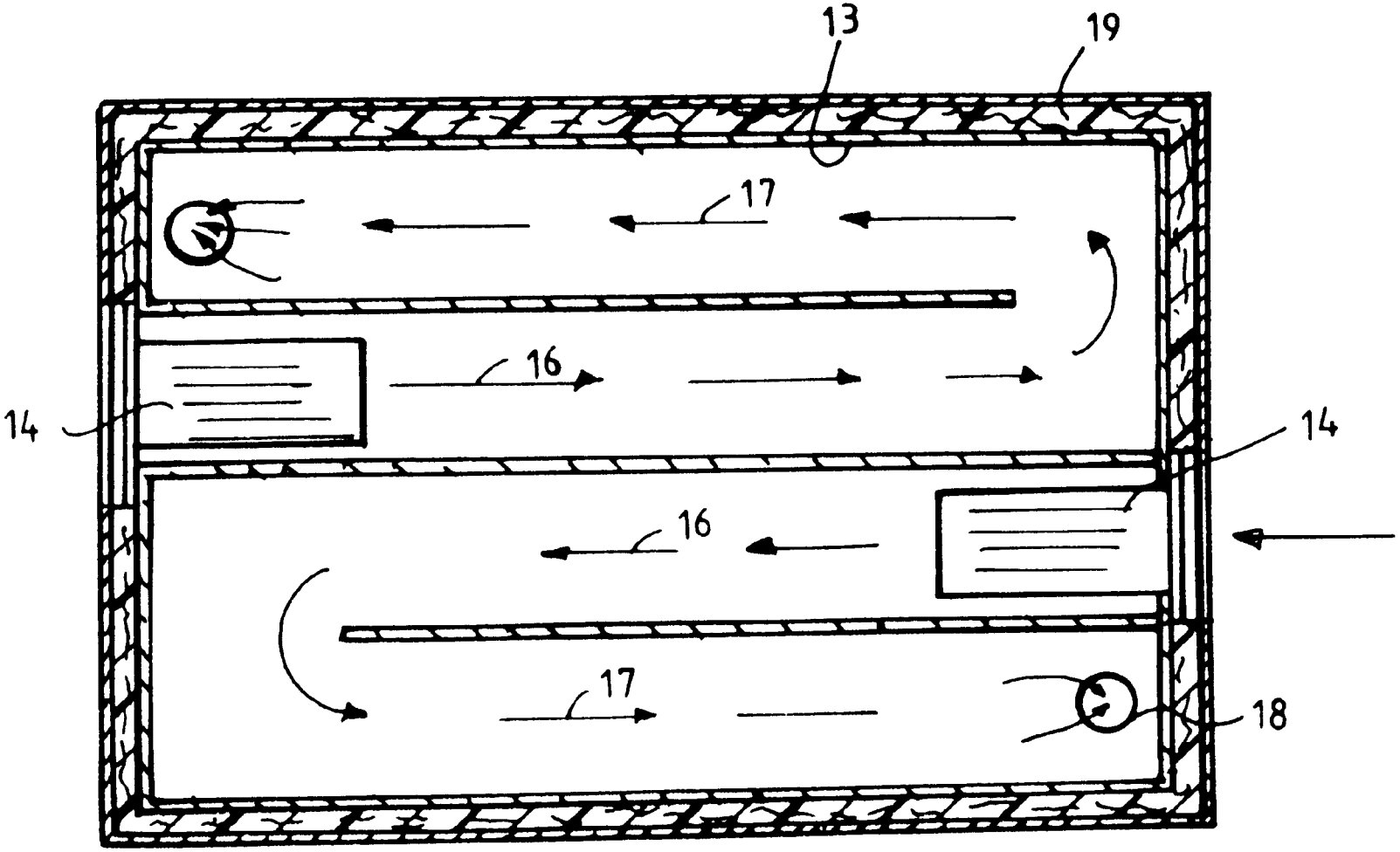
FIG. 4 is a schermatic sectioned plan on line IV—IV in FIG. 3.

It is a fiber feature of the invention that a facility is provided for heating material in the tank 10 and that heat transfer will take place along the bottom zone 10*b* of the tank 10 and also along at least part of the side walls 10*c* thereof. Thus in the embodiment illustrated in FIGS. 1 to 4, a heating box in the form of a structure 13 is provided below the tank and extends up the side walls 10*c* thereof to substantially the west point of the tank 10. It is envisaged that the interior of the heating box 13 will be heated either by means of one or more burners, not shown, which will be removably located in holders 14; or alternatively by means of a network of tubes 23 designed to carry a heating liquid such as oil. Preferably the interior of the heating box 13 will be partitioned by means of vertical ribs 15 as shown in FIG. 3 and FIG. 4 so that hot combustion gasses from the burner holders 14 will follow a sinuous outward and adjacent return pathway 16, 17 respectively to a chimney outlet 18. It will be noted that in the arrangement in FIG. 4, two opposed burner holders 14 and two opposed chimney outlets 18, are provided for efficient utilization of heat. Preferably insulation in the form of an outer packing of mineral wool, glass fiber mat or the like 19, on the outer surface of the tank 10 and the heating box 13 will be provided. A protective outer skin 20 of metal or plastics sheet material will enclose the insulation 19.

Figure 5:
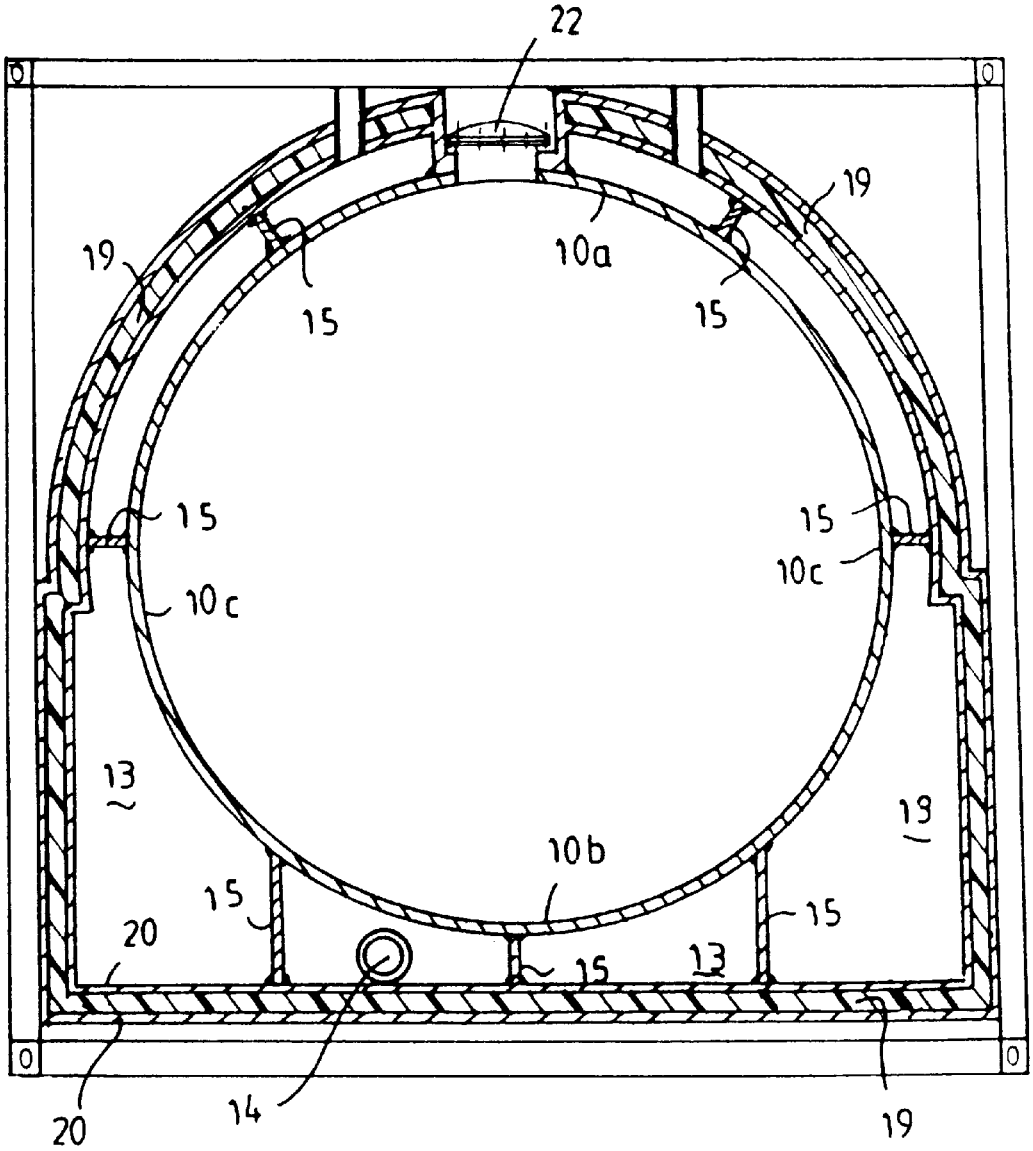
FIG. 5 is a schematic sectioned end elevation of a different embodiment to the container in FIG. 1.

A different embodiment to the one described above is shown in FIG. 5, wherein the heating box 13 extends around the entire side wall 10*c* of the container as well as the roof zone 10*d* thereof. The heating box thus extends around the entire container 10 and if required, could also extend over the end walls 10*a* of the cover 10. With this arrangement, additional partitions 15 will preferably be provided at least at the zone of the widest portion of the tank 10, and as described above, the hot combustion gasses will be ducted to follow an outward and return pathway between the various partions 15. With this arrangement, additional heat transfer area between the heating box 13 and the tank 15 is thus provided, to ensure efficient heat transfer and an overall gradual heat transfer process.

Figure 6:
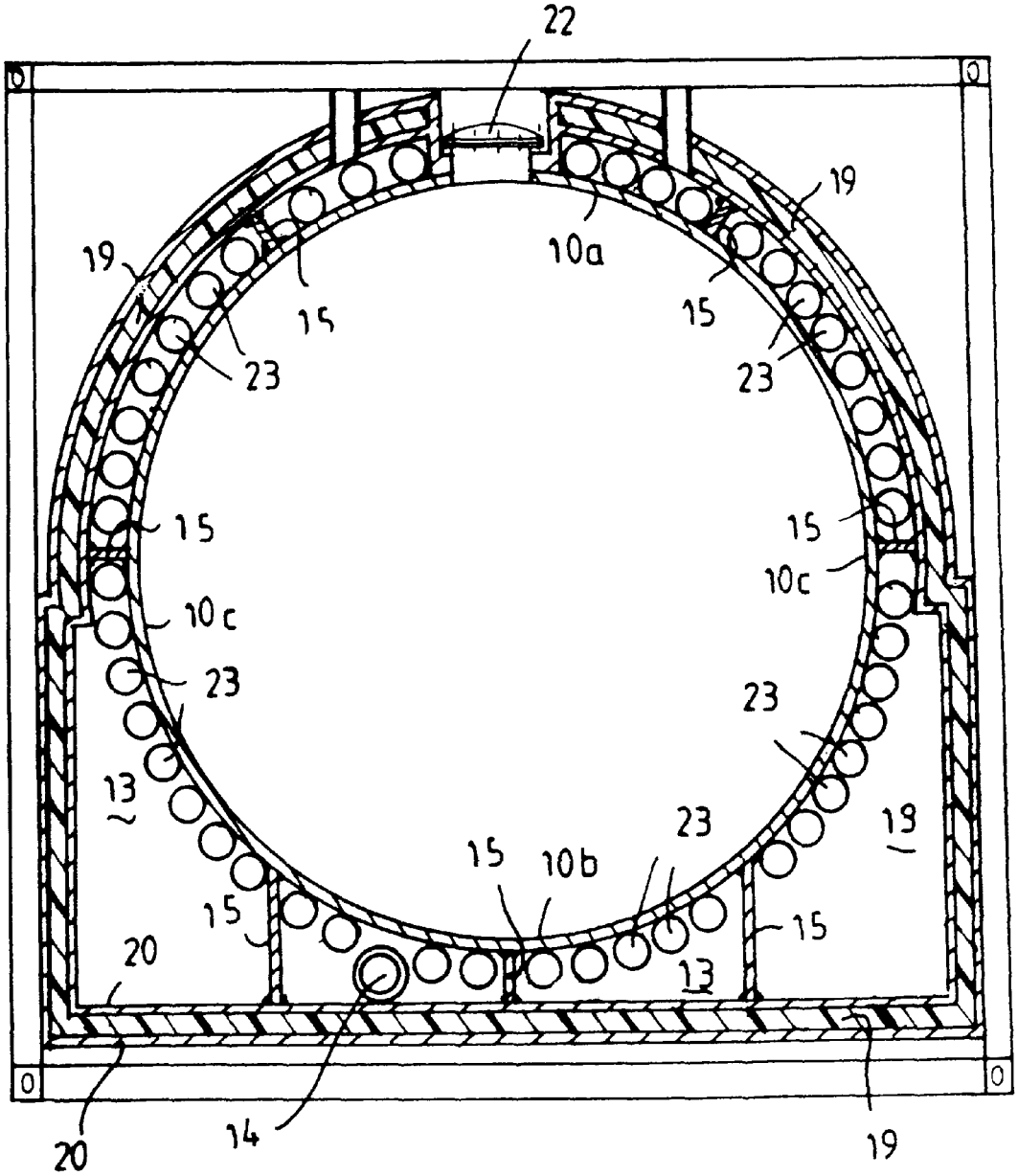
FIG. 6 is a schematic sectioned end elevation of yet a different embodiment to the container in FIG. 5.

In FIG. 6 yet a further variation of the invention is illustrated and in this arrangement the network of tubes 23 surrounds the tank 10 in a longitudinal direction. As stated above, the network of tubes 23 can be used as an alternative to hot combustion gasses for heating the tank 10. The tubes 23 could for example carry a heating liquid such as oil in a sinuous outward and return pathway or could be utilized for carrying a gaseous heating medium.

Preferably the tubes or pipes 23 will be disposed in contact with the tank 10 to transfer heat through conduction as well convection.

It has been found that the arrangement of the invention provides a large heat transfer area between the heating box 13 and the interior of the tank 10 which is advantageous from the point of view of efficient heat transfer. It has also been found that the degradation of material such as bitumen as a result of the heating is minimized by the large heat transfer area. In particular it has been found that a poor quality of bitumen can be successfully heated in the container of the invention to transform such bitumen to a sufficiently liquid state to be dispensed from a low level outlet shown at 21.

Doubtless variations in detail of the invention are possible without departing from the principles set out in the consistory clueses. For example, it win be appreciated that a suitable inlet to the container and access by way of a manhole or the like 22, can be provided as illustrated.

We claim:

1. A heatable container for bitumen compositions, comprising a tank defining a base zone, side wall zones, end wall zones and a roof zone, a heating box defining an encapsulating structure within which the base zone, side wall zones, and roof zone of the tank is housed, spaced from the tank; an inlet to the heating box and outlet from the heating box for a heating medium; a plurality of longitudinal partitions arranged in the heating box, to define a labyrinth of longitudinal to and fro flues for a heating medium introduced at the inlet to the heating box and discharged through the outlet, the heating box housing a greater volume at the base zone of the tank, than at the roof zone of the tank to provide a larger volume for heating medium at such base zone of the tank.

2. The container according to claim 1 wherein the heating box includes ducts which extend over the base zone, the side wall zones, and the roof zone of the container, said ducts being in the form of a plurality of pipe lengths disposed longitudinally about the periphery of the container, parallel to the longitudinal axis thereof, the pipe lengths being coupled so as to duct heating medium therein along a sinuous pathway.

3. The container according to any one of claim 1 wherein the body member is in the form of a tank structure with the base zone, side wall zones and roof zone defining a tubular structure of generally circular cross-section, and the end zones being domed outwardly.

4. The container according to claim 3 wherein the tank structure is mounted on supports within an ISO container frame.

5. The container according to claim 4 wherein the domed ends of the tank structure terminates short of the ends of the frame structure at one or both ends thereof, to permit access to the domed ends of the container for the introduction of a heating medium to the base zone thereof.

6. The container according to claim 5 wherein the domed ends terminate 0.5 meters short of the ends of the frame structure, and the diameter of the tank structure is approximately 2,3 meters in cross section.

* * * * *